US007900486B2

(12) United States Patent
Richman et al.

(10) Patent No.: US 7,900,486 B2
(45) Date of Patent: Mar. 8, 2011

(54) AGENT DISPENSER

(75) Inventors: Lonnie Joe Richman, Saint Joseph, MI (US); Sylvan James Amos, Kalamazoo, MI (US); Mustahsen Akhter Gull, Stevensville, MI (US); Flavio Erasmo Bernardino, Saint Joseph, MI (US); Thomas Lee Burger, Laporte, IN (US); Eric Kenneth Farrington, Saint Joseph, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 712 days.

(21) Appl. No.: 11/841,216

(22) Filed: Aug. 20, 2007

(65) Prior Publication Data

US 2009/0053119 A1 Feb. 26, 2009

(51) Int. Cl.
*D06F 39/02* (2006.01)

(52) U.S. Cl. ..... 68/17 R; 222/132; 222/192

(58) Field of Classification Search ..... 68/17 R; 222/132, 192

See application file for complete search history.

(56) References Cited

U.S. PATENT DOCUMENTS

| | | | | |
|---|---|---|---|---|
| 3,975,931 | A * | 8/1976 | Bischkopf | 68/17 R |
| 4,759,202 | A | 7/1988 | Caron | |
| 5,262,132 | A * | 11/1993 | Bricker et al. | 422/263 |
| 6,227,012 | B1 | 5/2001 | Borroni et al. | |
| 6,826,933 | B2 | 12/2004 | Merkle et al. | |
| 7,654,119 | B2 * | 2/2010 | Song | 68/17 R |
| 2007/0163307 | A1 | 7/2007 | Kramme et al. | |

FOREIGN PATENT DOCUMENTS

| | | | |
|---|---|---|---|
| EP | 0685587 | A1 | 12/1995 |
| EP | 1764437 | A1 | 3/2007 |

* cited by examiner

*Primary Examiner* — Joseph L Perrin
(74) *Attorney, Agent, or Firm* — Clifton G. Green; McGarry Bair PC

(57) ABSTRACT

An agent dispenser for a fabric treatment appliance includes a housing having a manifold and an agent compartment. The manifold may be configured to receive water and supply the water to the agent compartment through an outlet port. The agent compartment may be configured to receive an agent, such as a detergent or additive, in liquid or powder form. The outlet port may be in fluid communication with the bottom of the agent compartment to supply the water to the bottom of the agent compartment whereby the water supplied to the agent compartment mixes with the agent in the agent compartment substantially from the bottom up.

36 Claims, 11 Drawing Sheets

AGENT DISPENSER

BACKGROUND OF THE INVENTION

The invention relates to an agent dispenser for a fabric treatment appliance, such as a washing machine. Agent dispensers are well-known devices for receiving powder and/or liquid agents, such as washing agents and additives, including detergents, bleach and other oxidizers, and fabric softeners, and dispensing the agent into a receptacle of the fabric treatment apparatus for treating fabric items contained in the receptacle during an operation cycle of the fabric treatment appliance. Typically, water supplied to the agent dispenser mixes with the agent to form an agent solution, which is dispensed into the receptacle. Problems commonly encountered with agent dispensers may include clumping of a powder agent, poor mixing of the agent and water, premature interaction of agent with water remaining in the dispenser from a previous operation cycle, and overflowing the agent dispenser.

SUMMARY OF THE INVENTION

An agent dispenser according to one embodiment of the invention for a fabric treatment appliance comprises a housing, a manifold having at least one inlet port and at least one outlet port, and an agent compartment in the housing configured to receive an agent in liquid or powder form. The at least one outlet port is in fluid communication with the bottom of the agent compartment to supply water to the bottom of the agent compartment whereby the water supplied to the agent compartment mixes with the agent in the agent compartment substantially from the bottom up.

DESCRIPTION OF EMBODIMENTS OF THE INVENTION

Figure 1:
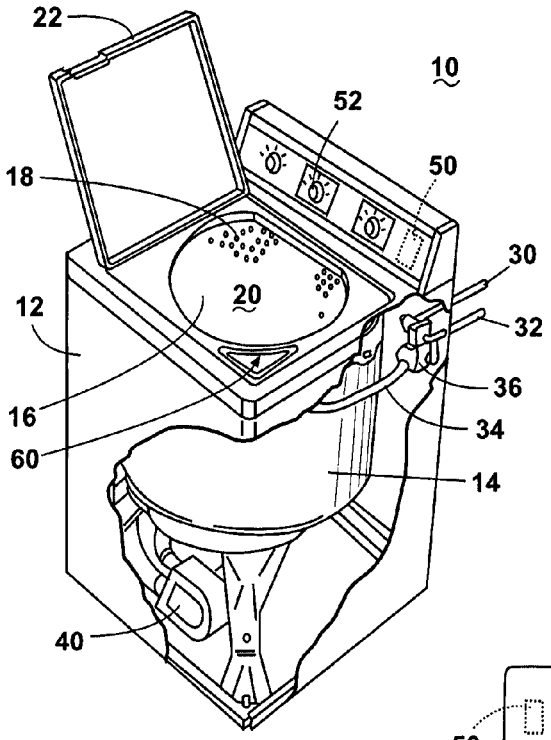
FIG. 1 is a perspective view of an exemplary fabric treatment appliance in the form of a washing machine with an agent dispenser according to one embodiment of the invention.

Referring now to the figures, FIG. 1 is a cutaway perspective view of an exemplary fabric treatment appliance in the form of a washing machine 10 showing the environment in which one or more embodiments of the invention can be used. The fabric treatment appliance may be any machine that treats fabrics, and examples of the fabric treatment appliance may include, but are not limited to, a washing machine, including top-loading, front-loading, vertical axis, and horizontal axis washing machines; a dryer, such as a tumble dryer or a stationary dryer, including top-loading dryers and front-loading dryers; a combination washing machine and dryer; a tumbling or stationary refreshing/revitalizing machine; an extractor; a non-aqueous washing apparatus; and a revitalizing machine. For illustrative purposes, the invention will be described with respect to a washing machine with the fabric being a clothes load, with it being understood that the invention may be adapted for use with any type of fabric treatment appliance for treating fabric and to other appliances, such as dishwashers, employing an agent dispenser.

Figure 2:
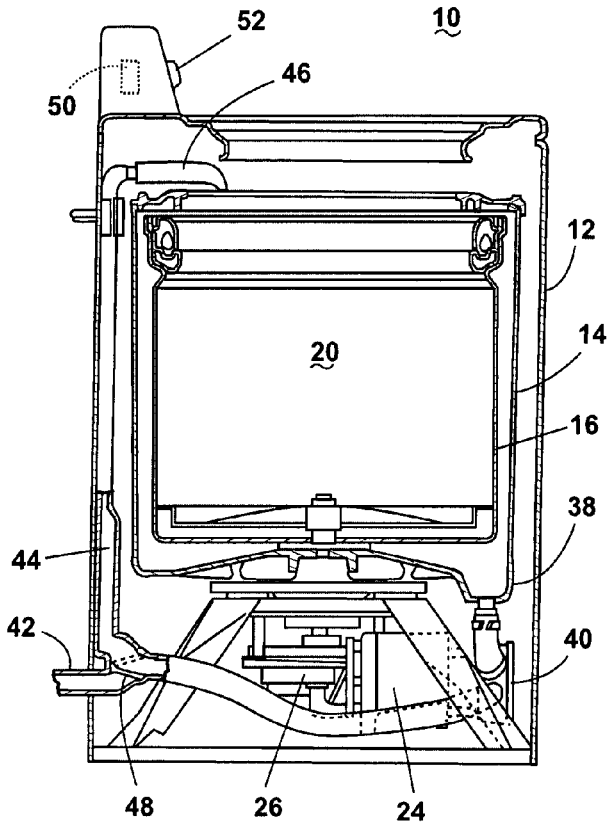
FIG. 2 is a sectional view of the washing machine of FIG. 1.

With additional reference to FIG. 2, which is a side sectional view of the washing machine 10 of FIG. 1, the washing machine 10 of the illustrated embodiment may include a cabinet 12 that houses a stationary tub 14. A rotatable drum 16 mounted within the tub 14 may include a plurality of perforations 18 (FIG. 1), and liquid may flow between the tub 14 and the drum 16 through the perforations 18. The drum 16 may define a chamber 20 for receiving fabric items to be treated. The chamber 20 may be accessible through a hinged lid 22 (FIG. 1), as is well-known in the washing machine art. A motor 24 coupled to the drum 16 through a transmission 26 may rotate the drum 16 at various speeds in opposite rotational directions.

The tub 14 and/or the drum 16 may be considered a receptacle, and the receptacle may define a fabric treatment chamber for receiving fabric items to be treated. While the illustrated washing machine 10 includes both the tub 14 and the drum 16, it is within the scope of the invention for the fabric treatment appliance to include only one receptacle, with the receptacle defining the fabric treatment chamber for receiving the fabric items to be treated.

Washing machines are typically categorized as either a vertical axis washing machine or a horizontal axis washing machine. As used herein, the "vertical axis" washing machine refers to a washing machine having a rotatable drum that rotates about a generally vertical axis relative to a surface that supports the washing machine. Typically, the drum is perforate or imperforate and holds fabric items and a fabric moving element, such as an agitator, impeller, nutator, and the like, that induces movement of the fabric items to impart mechanical energy to the fabric articles for cleaning action. However, the rotational axis need not be vertical. The drum can rotate about an axis inclined relative to the vertical axis. As used herein, the "horizontal axis" washing machine refers to a washing machine having a rotatable drum that rotates about a generally horizontal axis relative to a surface that supports the washing machine. The drum may be perforated or imperforate, holds fabric items, and typically washes the fabric items by the fabric items rubbing against one another and/or hitting the surface of the drum as the drum rotates. In horizontal axis washing machines, the clothes are lifted by the rotating drum and then fall in response to gravity to form a tumbling action that imparts the mechanical energy to the fabric articles. In some horizontal axis washing machines, the drum rotates about a horizontal axis generally parallel to a surface that supports the washing machine. However, the rotational axis need not be horizontal. The drum can rotate about an axis inclined relative to the horizontal axis, with fifteen degrees of inclination being one example of inclination.

Vertical axis and horizontal axis machines are best differentiated by the manner in which they impart mechanical energy to the fabric articles. In vertical axis machines, the fabric moving element moves within a drum to impart mechanical energy directly to the clothes or indirectly through wash liquid in the drum. The clothes mover is typically moved in a reciprocating rotational movement. In horizontal axis machines mechanical energy is imparted to the clothes by the tumbling action formed by the repeated lifting and dropping of the clothes, which is typically implemented by the rotating drum, although the use of a fabric moving element in a horizontal axis machine is also possible. The illustrated exemplary washing machine 10 of FIGS. 1 and 2 is a vertical axis washing machine.

With continued reference to FIGS. 1 and 2, the washing machine 10 may further include a liquid supply and recirculation system. Liquid, such as water, may be supplied to the washing machine 10 from a water supply, such as a household water supply, via, for example, hot and cold water supply inlets 30, 32. A water supply conduit 34 may fluidly couple the hot and cold water supply inlets 30, 32 to an agent dispenser 60. A valve assembly 36 may control flow of the water from the hot and cold water supply inlets 30, 32 and through the water supply conduit 34 to the agent dispenser 60. The valve assembly 36 may be positioned in any suitable location between the hot and cold water supply inlets 30, 32 and the agent dispenser 60. It is within the scope of the invention for the liquid supply system to include any number of water supply inlets, such as only one inlet, i.e., only the cold water supply inlet 32. The agent dispenser 60 may be fluidly coupled with the tub 14 and/or the drum 16 for dispensing an agent solution formed by the agent and the water to the fabric treatment chamber, as will be described in more detail below. The agent solution that flows from the agent dispenser 60 typically enters a space between the tub 14 and the drum 16 and may flow by gravity to a sump 38 formed by a lower portion of the tub 14. A pump 40 fluidly coupled to the sump 38 may direct fluid to a drain conduit 42, which may drain the liquid from the washing machine 10, or to a recirculation conduit 44, which may terminate at a recirculation inlet 46. A two-way valve 48 provided at the juncture of the drain conduit 42 and the recirculation conduit 44 may alternately direct liquid flow to the drain conduit 42 or the recirculation conduit 44. The recirculation inlet 46 at the end of the recirculation conduit 44 may direct the liquid from the recirculation conduit 44 into the drum 16. The recirculation inlet 46 may introduce the liquid into the drum 16 in any suitable manner, such as by spraying, dripping, or providing a steady flow of the liquid.

The liquid supply and recirculation system may differ from the configuration shown in FIGS. 1 and 2, such as by inclusion of other valves, conduits, agent dispensers, and the like, to control the flow of liquid through the washing machine 10 and for the introduction of more than one type of agent. Further, the washing machine 10 may include a heating system for heating liquid in the washing machine 10. The heating system may include a sump heater, a steam generator, a combination of a sump heater and a steam generator, or other types of devices for heating the liquid.

The washing machine 10 may further include a controller 50 coupled to various working components of the washing machine 10, such as the motor 24, the valve assembly 36, the pump 40, the two-way valve 48, the agent dispenser 60, and other valves and sensors commonly employed in washing machines, such as temperature sensors and pressure sensors, to control the operation of the washing machine 10. The controller 50 may receive data from one or more of the working components or sensors and may provide commands, which can be based on the received data, to one or more of the working components to execute a desired operation of the washing machine 10. The commands may be data and/or an electrical signal without data. A control panel 52 may be coupled to the controller 50 and may provide for input/output to/from the controller 50. In other words, the control panel 52 may perform a user interface function through which a user may enter input related to the operation of the washing machine 10, such as selection and/or modification of an operation cycle of the washing machine 10, and receive output related to the operation of the washing machine 10.

Many known types of controllers may be used for the controller 50. The specific type of controller is not germane to the invention. It is contemplated that the controller may be a microprocessor-based controller that implements control software and sends/receives one or more electrical signals to/from each of the various components to effect the control software. As an example, proportional control (P), proportional integral control (PI), and proportional derivative control (PD), or a combination thereof, a proportional integral derivative control (PID), may be used to control the various components.

Figure 3:
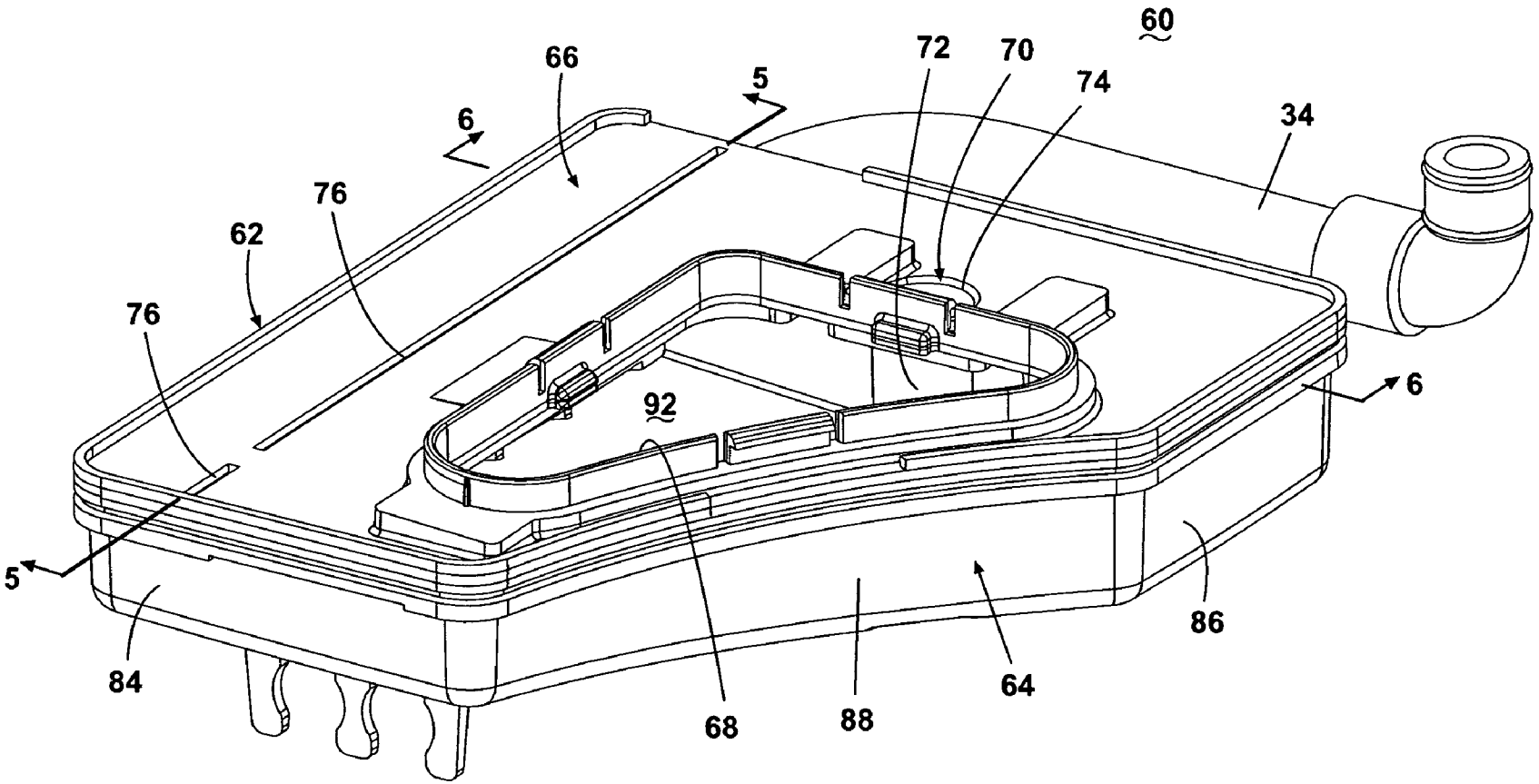
FIG. 3 is perspective view of the agent dispenser of FIG. 1 having a receptacle and a cover according to one embodiment of the invention.

FIG. 3 is a perspective view of the agent dispenser 60 according to one embodiment of the invention. The agent dispenser 60 may typically be used with a liquid agent, a powder agent, or both a liquid agent and a powder agent. The agent may be any agent for treating fabric, and examples of agents may include, but are not limited to washing agents, such as detergents and oxidizers, including bleaches, and additives, such as fabric softeners, sanitizers, de-wrinklers, and chemicals for imparting desired properties to the fabric, including stain resistance, fragrance (e.g., perfumes), insect repellency, and UV protection.

Figure 4:
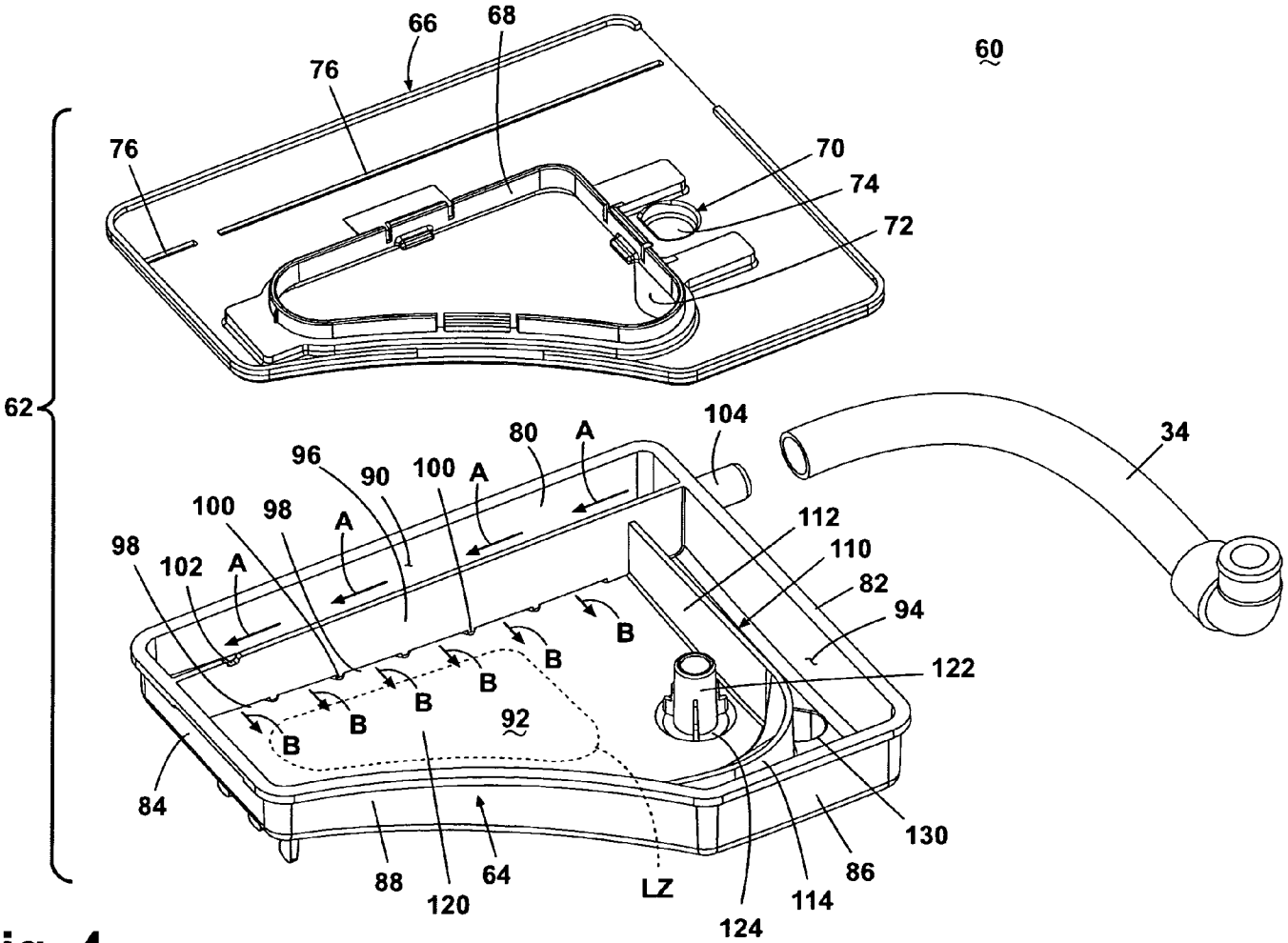
FIG. 4 is an exploded view of the agent dispenser of FIG. 3.

The agent dispenser 60 of the illustrated embodiment includes a housing 62 formed by an open-top receptacle 64 closed by a cover 66. The housing 62 of the illustrated embodiment is shaped to fit in a desired location, such as a corner, of the washing machine 10, but it is within the scope of the invention for the housing 62 to have any suitable configuration. As shown in FIG. 4, which is an exploded view of the agent dispenser 60 of FIG. 3, the cover 66 includes an opening 68 for receipt of the agent, such as by manual introduction of the agent through the opening 68 by a user. The cover 66 further includes a siphon tube receiver 70 having a downwardly extending cylindrical body 72 with a closed top 74. Additionally, a segmented, generally linear rib 76 extends downwardly from the cover 66 toward the receptacle 64.

With continued reference to FIG. 4, the receptacle 64 includes first and second orthogonal sidewalls 80, 82, a third sidewall 84 orthogonal to the first sidewall 80 and opposed to the second sidewall 86, a fourth sidewall 86 orthogonal to the second sidewall 82 and opposed to the first sidewall 80, and an arcuate fifth sidewall 88 joining the third and fourth sidewalls 84, 86. In this embodiment, the arcuate fifth sidewall 88 is provided to accommodate the space necessary for the drum 16, and the shape of the fifth sidewall 88 is not to be considered critical to the invention. As stated above, the housing 62 may have any suitable configuration, and the particular configuration described herein is for illustrative purposes only. An inlet compartment 90, an agent compartment 92, and an overflow compartment 94 in this embodiment are defined within the sidewalls 80, 82, 84, 86, 88.

Figure 5:
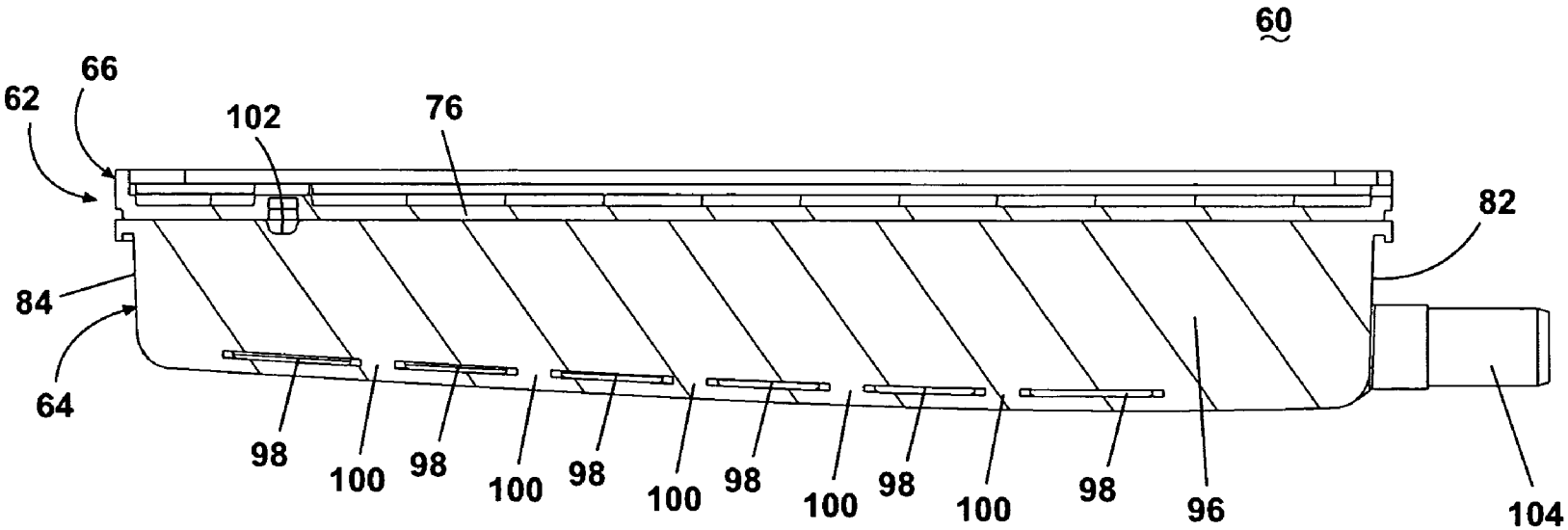
FIG. 5 is a sectional view taken along line 5-5 of FIG. 3.

In particular, the inlet compartment 90 is defined between the first sidewall 80 and a generally vertical, upstanding wall 96 spaced from the first sidewall 80, along with the connecting portions of the first and third sidewalls 82, 84. Near or at a bottom edge of the wall 96, a plurality of outlet ports in the form of spaced, elongated slits or openings 98 separated by partitions 100 provides fluid communication between the inlet compartment 90 and the agent compartment 92, which, in the exemplary embodiment, is located adjacent to the inlet compartment 90 on the opposite side of the wall 96. In different embodiments of the invention, the number, location, and shape of the openings 98 may vary from what is shown in FIG. 4. The wall 96 may further include a air vent 102, such as the opening 102 disposed near or at an upper edge of the wall 96. An inlet port 104, which can be located in any suitable position and is shown as being located at the second sidewall 82, provides an entry for the supply of water to the agent dispenser 60 through the inlet compartment 90. The water supply conduit 34 may be coupled to the inlet port 104 to introduce the water into the inlet compartment 90. In alternate embodiments of the invention, the inlet port 104 and the inlet compartment 90 may be substantially integrated such that the inlet compartment 90 becomes substantially reduced in size, e.g., resembling a multiple nozzle shower head. As shown in FIG. 5, which is a sectional view taken along the wall 96, the rib 76 on the cover 66 mates with the wall 96, and the cover 66 and the receptacle 64 are coupled, such as through ultrasonic welding or other suitable joining process, including a snap fit, to seal the inlet compartment 90, except for the inlet port 104, the openings 98, and the air vent 102.

Referring back to FIG. 4, the receptacle 64 further includes an overflow wall 110 having, in this embodiment, a generally linear portion 112 parallel to and spaced from the second sidewall 82 and an arcuate portion 114 spaced from the second and fourth sidewalls 82, 86. The linear portion 112 extends from the wall 96 and joins with the arcuate portion 114 near the juncture of the second sidewall 82 with the fourth sidewall 86. The overflow wall 110 divides that portion of the receptacle 64 excluding the inlet compartment 90 into the agent compartment 92 and the overflow compartment 94.

The agent compartment 92 is defined between the wall 96, the overflow wall 110, the third sidewall 84, and the fifth sidewall 88. The agent compartment 92 is also defined, in part, by a bottom wall 120 of the receptacle 64. Further, the agent compartment 92 includes a loading zone LZ, shown by a dashed line in FIG. 4, which in this embodiment is characterized as that portion of the agent compartment 92 in registry with the opening 68 of the cover 66 and an area surrounding the portion in registry with the opening 68 such that the agent introduced through the opening 68 primarily loads into the loading zone LZ of the agent compartment 92. The loading zone LZ in the current embodiment contains no structure to positively hold the agent in the loading zone LZ, but the agent, particularly an agent in powder form, will tend to reside in the loading zone LZ due to the registry of the opening 68 with the loading zone LZ. In reality, some of the agent may naturally flow to areas of the agent compartment 92 outside the loading zone LZ. The area outlined by the dashed line in FIG. 4 to represent the loading zone LZ is provided for illustrative purposes and is not intended to limit the metes and bounds of the loading zone LZ.

Figure 6:
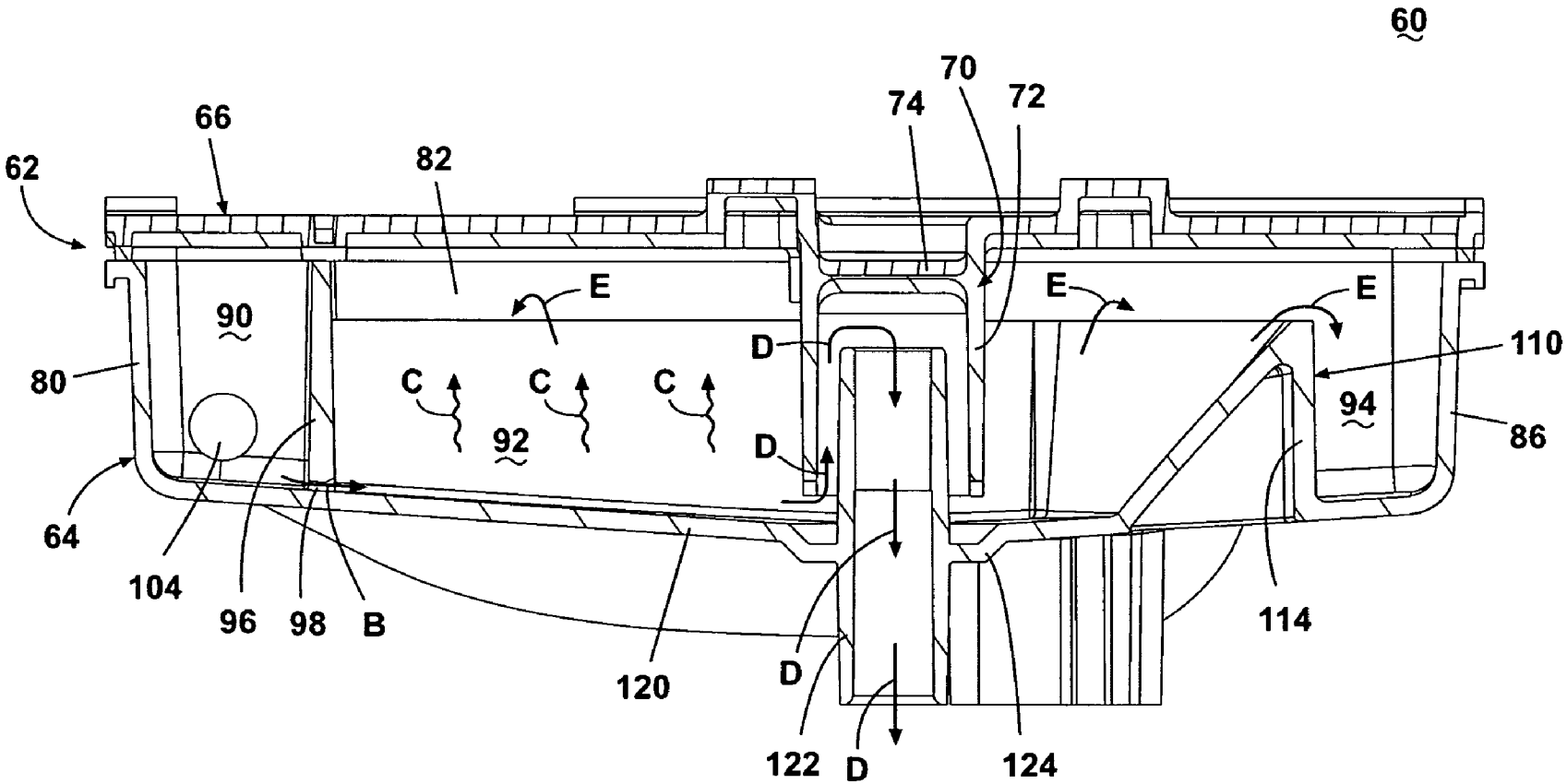
FIG. 6 is a sectional view taken along line 6-6 of FIG. 3.

As seen in FIG. 6, which is a sectional view taken along a plane generally parallel to the linear portion 114 of the overflow wall 110, the bottom wall 120 may be inclined to encourage flow of water and agent solution toward a siphon tube 122 in the agent compartment 92 during operation of the agent dispenser 60, as described in more detail below. The siphon tube 122 extends above and below the bottom wall 120 of the receptacle 64 and may be surrounded by a siphon sump 124 formed in the bottom wall 120 of the receptacle 64. The portion of the siphon tube 122 extending above the bottom 120 and into the agent compartment 92 may be received within the cylindrical body 72 of the siphon receiver 70 formed in the cover 66. The siphon tube 122 and the siphon receiver 70 form a siphon device for removal of the agent solution from the agent receptacle 92 during operation of the agent dispenser 60. The siphon tube 122 may be fluidly coupled to any desirable location in the washing machine 10, such as the space between the tub 14 and the drum 16, as described above. A valve or other flow control device may be located downstream from the siphon tube 122 to control flow out of the agent dispenser 60.

Referring back to FIG. 4, the overflow compartment 94 is defined by the overflow wall 110, the second sidewall 82, the fourth sidewall 86, and connecting portions of the wall 96 and the fifth sidewall 88. The overflow wall 110 has a height less than the distance between the bottom wall 120 and the cover 66 such that an upper edge of the overflow wall 110 is spaced from the cover 66, as seen in FIGS. 4 and 6, to provide fluid communication between the agent compartment 92 and the overflow compartment 94. With continued reference to FIG. 4, the overflow compartment 94 includes a drain port 130, which is preferably fluidly coupled to the same destination as the siphon tube 122, although it is within the scope of the invention for it to be coupled elsewhere.

During operation of the washing machine 10, the agent dispenser 60 is employed to dispense the agent contained therein into the fabric treatment chamber under the control of the controller 50 by way conventional valving (such as the valve assembly 36) to control the supply of water to the inlet port 110 or the drain of water from the siphon tube 122 and/or the drain port 130. At any suitable time, such as before the start of the operation or during the operation, the user may introduce the agent, typically in either powder or liquid form, into the agent dispenser through the opening 68. The agent enters the agent compartment 92 and is deposited primarily in the loading zone LZ of the agent compartment 92. Some of the agent may enter areas of the agent compartment 92 outside the loading zone LZ.

When time comes to dispense the agent, the controller 50 signals the valve assembly 36 to supply water to the agent dispenser 60 through the water supply conduit 34. Water is normally supplied for predetermined period of time. The water enters the agent dispenser 60 through the inlet port 104 into the inlet compartment 90 under its ambient pressure, as indicated by arrows labeled A in FIG. 4. In this embodiment, the openings 98 are located near or at the bottom of the wall 96 and distributed through its length. As the water enters the inlet compartment 90, its ambient pressure also urges the water through the openings 98 into the agent compartment 92, as indicated by arrows labeled B in FIGS. 4 and 6. In normal usage, in the embodiment shown, the water pressure typically is high enough that the incoming water is effectively distributed across the bottom wall 120 of the agent compartment 92. As well, the openings 98 are sized small enough that the water is urged into the agent compartment 92 at a relatively high velocity. The velocity may or may not be higher than the velocity of the water entering the inlet compartment 90, but it will preferably be high enough to enhance mixing of any powders deposited in the loading zone LZ with the water.

Thus, for a powder agent, the water entering the agent compartment 92 at a relatively high velocity along the bottom wall 120 of the agent compartment 92 tends to turbulently lift, suspend, and jostle the powder agent, thereby facilitating mixing of the agent with the water from the bottom up to form the agent solution, as indicated by arrows labeled C in FIG. 6. For a liquid agent, the water entering the agent compartment 92 has a similar effect to facilitate mixing of the agent with the water. The agent solution need not be a solution with the agent fully dissolved in the water; rather, the agent solution may have a dispersion of the agent in the water so that the water may carry the agent to the desired location.

The water, any undissolved agent, and the agent solution flow toward the siphon tube 122 and exit the agent dispenser through the siphon tube 122, as indicated by arrows labeled D in FIG. 6. Flow through a siphon device in a dispenser of this type is a well-known concept and will not be described here for brevity. Any type of siphon device may be employed with the agent dispenser 60 for dispensing the agent solution from the agent compartment 92. In the illustrated embodiment, the configuration of the siphon tube 122 and the siphon receiver 70 may be set to achieve a desired siphon flow. For example, the height and diameter of the siphon tube 122 and/or the cylindrical body 72 of the siphon receiver 70 may be predetermined to achieve a desired flow rate.

The air vent 102 in the wall 96 facilitates establishing a stable, swift and uninterrupted siphon flow of the agent solution from the agent compartment 92 through the siphon tube 122, by enabling the prompt removal of water remaining in the inlet compartment 90 until it is reasonably evacuated. The air vent 102 allows air to flow from the agent compartment 92 into the inlet compartment 90 to enable the siphon to draw water remaining in the inlet compartment 90 out of the inlet compartment 90, especially when the valve assembly 36 is closed. Air entering the inlet compartment 90 through the air vent 102 compensates for the water leaving the inlet compartment 90 and inhibits formation of a vacuum in the inlet compartment 90 that would otherwise retard or interrupt the siphoning through the siphon tube 122.

If, at any time during the operation of the agent dispenser 60, the level of the agent solution in the agent compartment 92 rises to the upper edge of the overflow wall 110, any additional supply of water to the agent compartment not accommodated by the agent solution leaving the agent compartment 92 through the siphon tube 122 will tend to cause overflow of the agent, water, or agent solution into the overflow compartment 94, as indicated by arrows labeled E in FIG. 6. In other words, if the siphon flow through the siphon tube 122 cannot draw the agent solution from the agent compartment 92 at a rate sufficient to maintain the level in the agent compartment 92 below the upper edge of the overflow wall 110, the contents of the agent compartment 92 will flow over the overflow wall 110 and into the overflow compartment 94. The overflow into the overflow compartment 94 leaves the agent dispenser 60 through the drain port 130 to a desired location. The overflow compartment 94, therefore, prevents the agent dispenser 60 from overflowing and leaking. Further, large particulates of the agent, if present, will float or be propelled to the surface of the agent solution in the agent compartment 92 and flow into the overflow compartment 94 should the level of agent solution in the agent compartment 92 rise to the upper edge of the overflow wall 110, thereby evacuating the large particulates from the agent compartment 92. The drain port 130 may be sized to accommodate the large particulates, and the bottom 120 of the receptacle 64 in the overflow compartment 92 may be inclined toward the drain port 130 to facilitate fluid flow toward the drain port 130.

The supply of water to the inlet compartment 90 during the operation of the agent dispenser 60 can be controlled in any suitable manner to achieve a desired flow of water into the agent compartment 92. The particular parameters employed for controlling the valve assembly 36 will normally depend on characteristics of the water supply, such as water pressure, design of the washing machine 10, type of agent, and configuration and size of the agent dispenser 60. For example, the water flow can be controlled to supply water continuously or intermittently into the inlet compartment 90. In one embodiment, the water flow may be controlled to supply water to the inlet compartment 90 for a first predetermined period of time, such as about twenty seconds, cease supply of water for a second predetermined period of time, such as about fifteen seconds, and supply water again for a third predetermined period of time, equal to or different from the first predetermined period of time. The water supply may be controlled at a time later in the operation of the washing machine 10 or after the operation of the washing machine 10 to rinse the agent dispenser 60.

The inlet compartment 90, including the inlet port 104 and the outlet port in the form of the openings 98, form a manifold for the agent dispenser 60. The manifold in this embodiment is a conventional manifold having a single inlet and multiple outlets; however, it is within the scope of the invention for the manifold to have any suitable number of inlets and any suitable number of outlets (e.g., single inlet/single outlet, single inlet/multiple outlets, multiple inlets/multiple outlets, multiple inlets/single outlet). The manifold functions to adapt the flow of water supplied by the water supply conduit 34 to the bottom of the agent compartment 92 such that the water supply mixes with the agent in the agent compartment 92 substantially from the bottom up. Other examples of the manifold may include, but are not limited to, the multiple nozzle shower head described above, an adapter to adapt the flow of water from the conduit into a generally triangular, cone, or other shape spray of water similar to adapters used on garden hoses. In other words, the manifold need not constitute a distinct compartment in the agent dispenser 60 but may take the form of an adapter located between the water supply conduit 34 and the agent compartment 92. It is believed that distributing the flow across the bottom of the agent compartment at a relatively high velocity enables a dispenser according to the invention to effectively handle liquid or powder agents.

The receptacle 64 may be configured in any suitable manner to achieve a desired flow of water into the inlet compartment 90 and the agent compartment 92 in accord with the invention. Alternative embodiments illustrating other exemplary configurations for the receptacle 64 are shown in FIGS. 7 and 8.

Figure 7:
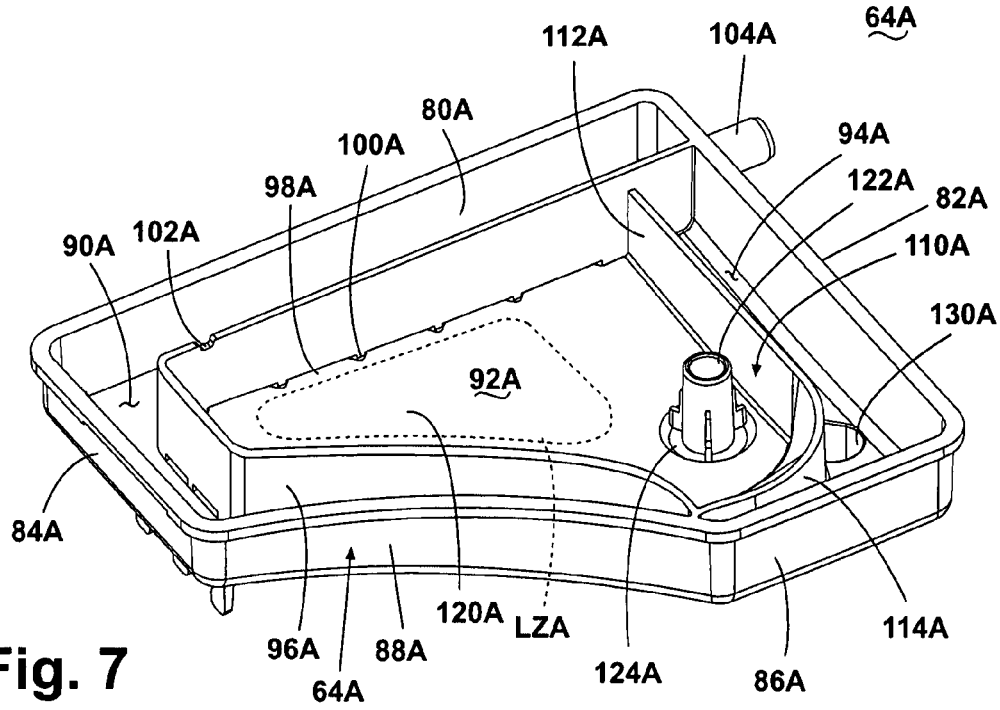
FIG. 7 is a perspective view of a first alternative receptacle for the agent dispenser of FIG. 3 according to one embodiment of the invention.

Referring now to FIG. 7, where elements similar to those of the receptacle 64 in the embodiment of FIGS. 3-6 are identified with the same reference numeral bearing the letter "A," an alternative receptacle 64A is substantially similar to the receptacle 64 of FIGS. 3-6, except that the inlet compartment 90A of the receptacle 64A of FIG. 7 is configured to extend around more of the perimeter of the agent compartment 92A. For example, the inlet compartment 90A extends around approximately three-quarters of the perimeter of the agent compartment 92A, particularly along the first, third, and fifth sidewalls 80A, 84A, 88A. In contrast, the inlet compartment 90 of FIGS. 3-6 extends around approximately one-quarter of the agent compartment 90A, particularly along the first sidewall 80. It is within the scope of the invention for the inlet compartment to have any suitable perimeteral length relative to the agent compartment to achieve a desired flow rate and flow pattern of water into the agent compartment. For example, the inlet compartment may extend around the entire perimeter of the agent compartment in an embodiment lacking the overflow compartment. The openings 98A may be located along the entire wall 96A, as in the embodiment of FIG. 7, or may be located in selected locations along the wall 96A to achieve a desired flow rate and flow pattern of water into the agent compartment 96A.

Figure 8:
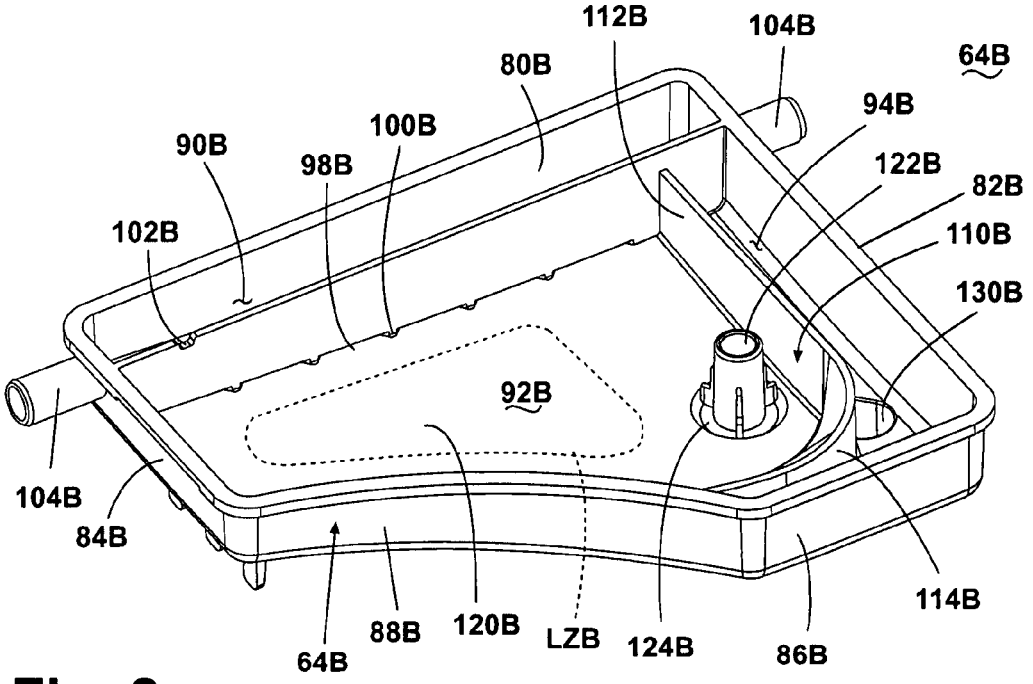
FIG. 8 is a perspective view of a second alternative receptacle for the agent dispenser of FIG. 3 according to one embodiment of the invention.

Referring now to FIG. 8, where elements similar to those of the receptacle 64 in the embodiment of FIGS. 3-6 are identified with the same reference numeral bearing the letter "B," an alternative receptacle 64B is substantially similar to the receptacle 64 of FIGS. 3-6, except that the inlet compartment 90B of the receptacle 64B of FIG. 8 includes multiple inlet ports 104B to accommodate multiple supplies of water to the inlet compartment 90B. In particular, the exemplary inlet compartment 90B has one of the inlet ports 104B on the second sidewall 80B and another of the inlet ports 104B on the third sidewall 84B. The inlet compartment 90B may include any desired number of the inlet ports 104 in any suitable locations to achieve a desired flow rate and flow pattern of water, and two of the inlet ports 104B are shown in FIG. 8 for illustrative purposes.

It is also contemplated to vary the size of the openings 98 in any embodiment of the agent dispenser 60 to achieve a desired flow rate and flow pattern of water. For example, successive openings 98 away from the inlet port 104 can be defined by increasing length and, therefore, increasing area. Such a configuration may be considered to accommodate a reduction in water pressure as a function of distance from the inlet port 104. Conversely, a system with a sufficiently high water pressure may not benefit from such a variation in the size of the openings 98.

It is also contemplated to vary the direction of water flow into the inlet port 104 compared to the direction of water flow from the inlet compartment 90 into the agent compartment 92. In the embodiments described thus far, the direction of water flow into the inlet compartment 90 via the inlet port 104 is generally perpendicular to the direction of water flow from the inlet compartment 90 into the agent compartment 92. The two directions may have another relative configuration, such as a parallel configuration or at an angle between perpendicular and parallel. In some embodiments, the relative directions may be dictated by the configuration of the washing machine 10 and the space available for the agent dispenser 60.

It is also contemplated to position the inlet compartment 90 in a position other than adjacent to the agent compartment 92 such that the water may flow from the inlet compartment 90 and through the bottom wall 120 of the receptacle 64 into the agent compartment 92. This type of water flow into the agent compartment 92 may achieve the same effect as the water flow that results from positioning of the openings 98 near or at the bottom of the wall 96 in the embodiment of FIGS. 3-6 in that the water enters the agent compartment 92 at the bottom of the agent compartment 92 and thereby lifts, suspends, and moves the agent. This configuration results in effectively locating the openings 98 at the bottom wall 120 of the receptacle 64 in the agent compartment 92 and may be employed with the agent in powder form; the size of the openings 98 may be sufficiently small to prevent the powder agent from falling through the openings 98. Alternately, if a an agent in liquid form were to be used, typically some type of trap, valve, or other appropriate device known to those skilled in the art may be used to contain the liquid agent between the inlet port 104 and the receptacle 64 or in the receptacle 64.

Figure 9:
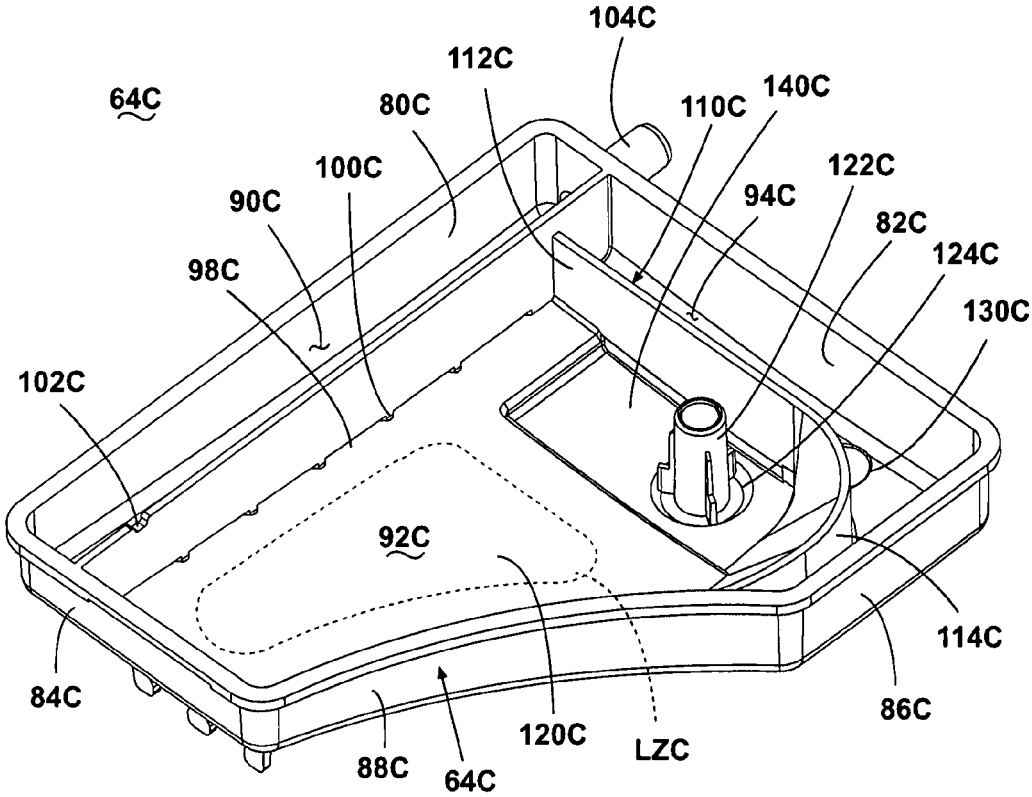
FIG. 9 is a perspective view of a third alternative receptacle for the agent dispenser of FIG. 3 according to one embodiment of the invention.
Figure 10:
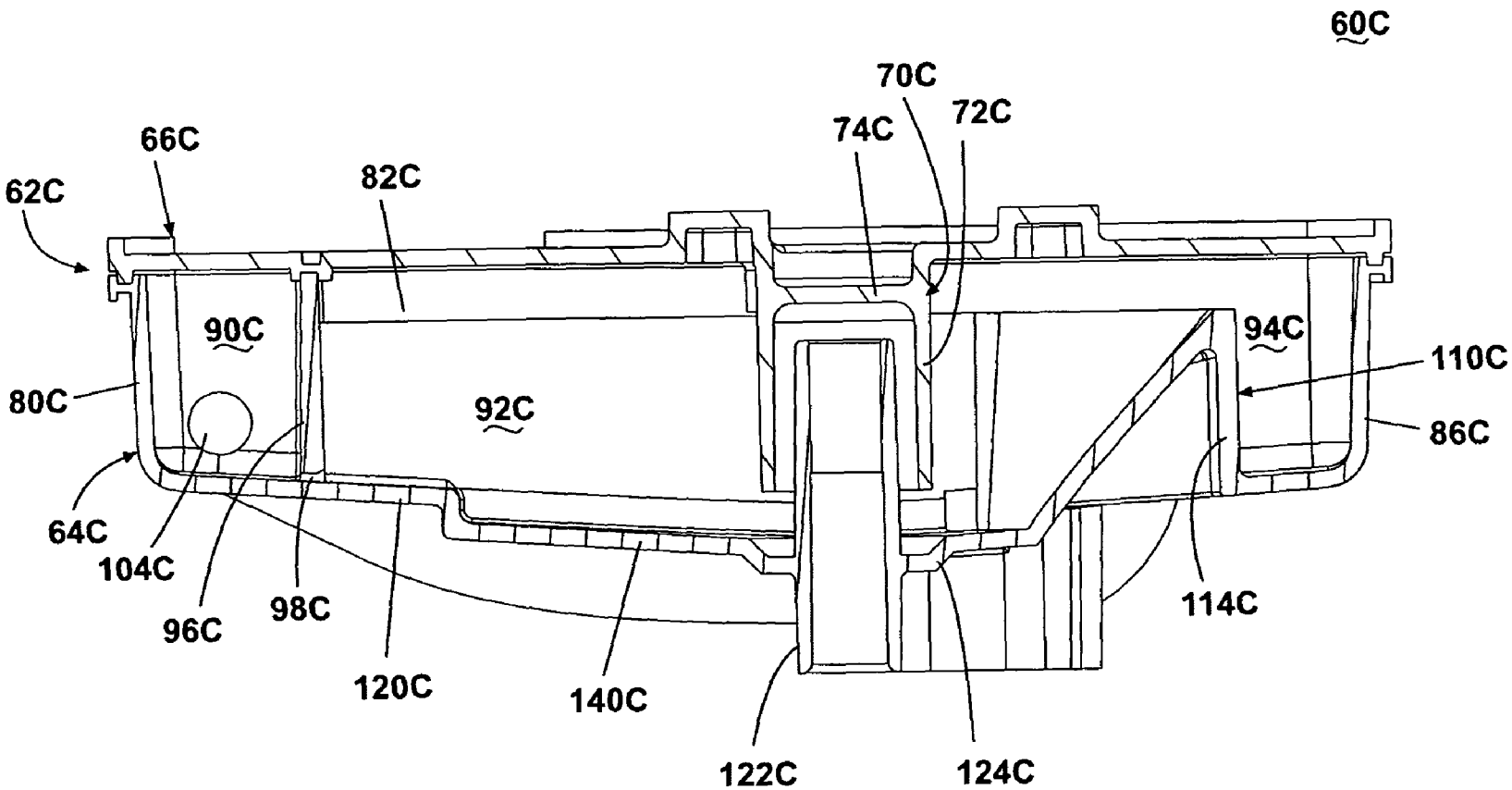
FIG. 10 is a sectional view similar to FIG. 6 of an alternative agent dispenser having the third alternative receptacle of FIG. 9.

Another embodiment of the receptacle 64C is illustrated in FIGS. 9 and 10, where elements similar to those of the receptacle 64 in the embodiment of FIGS. 3-6 are identified with the same reference numeral bearing the letter "C." As seen in FIG. 9, the exemplary alternative receptacle 64C is substantially similar to the receptacle 64 of FIGS. 3-6, except that the bottom 120C of the receptacle 64C is generally flat rather than sloped or inclined, or is less sloped or inclined than the bottom wall 120, and includes a well 140C surrounding the siphon conduit 122C. While the well 140C in the illustrated embodiment is generally rectangular, the well 140C may have any suitable configuration. The loading zone LZC resides on the bottom 120C and does not extend into the well 140C such that the agent introduced in the agent compartment 92C substantially resides in the loading zone LZC rather than the well 140C, which may hold residual water and/or agent remaining from the previous operation cycle. FIG. 10, which is a sectional view similar to FIG. 6 of an alternative agent dispenser 60C employing the alternative receptacle 64C, illustrates that the well 140C may be inclined toward the siphon tube 122 to facilitate flow of the agent, water, and agent solution in the well 140C toward the siphon tube 122C for maximum removal of the agent, water, and agent solution from the well 140C through the siphon tube 122C during operation of the agent dispenser 60. The receptacle 64C may include the sump 124C surrounding the siphon tube 122C in addition to the well 140C, or, alternatively, the receptacle 64C may include only the well 140C surrounding the siphon tube 122C.

Figure 11:
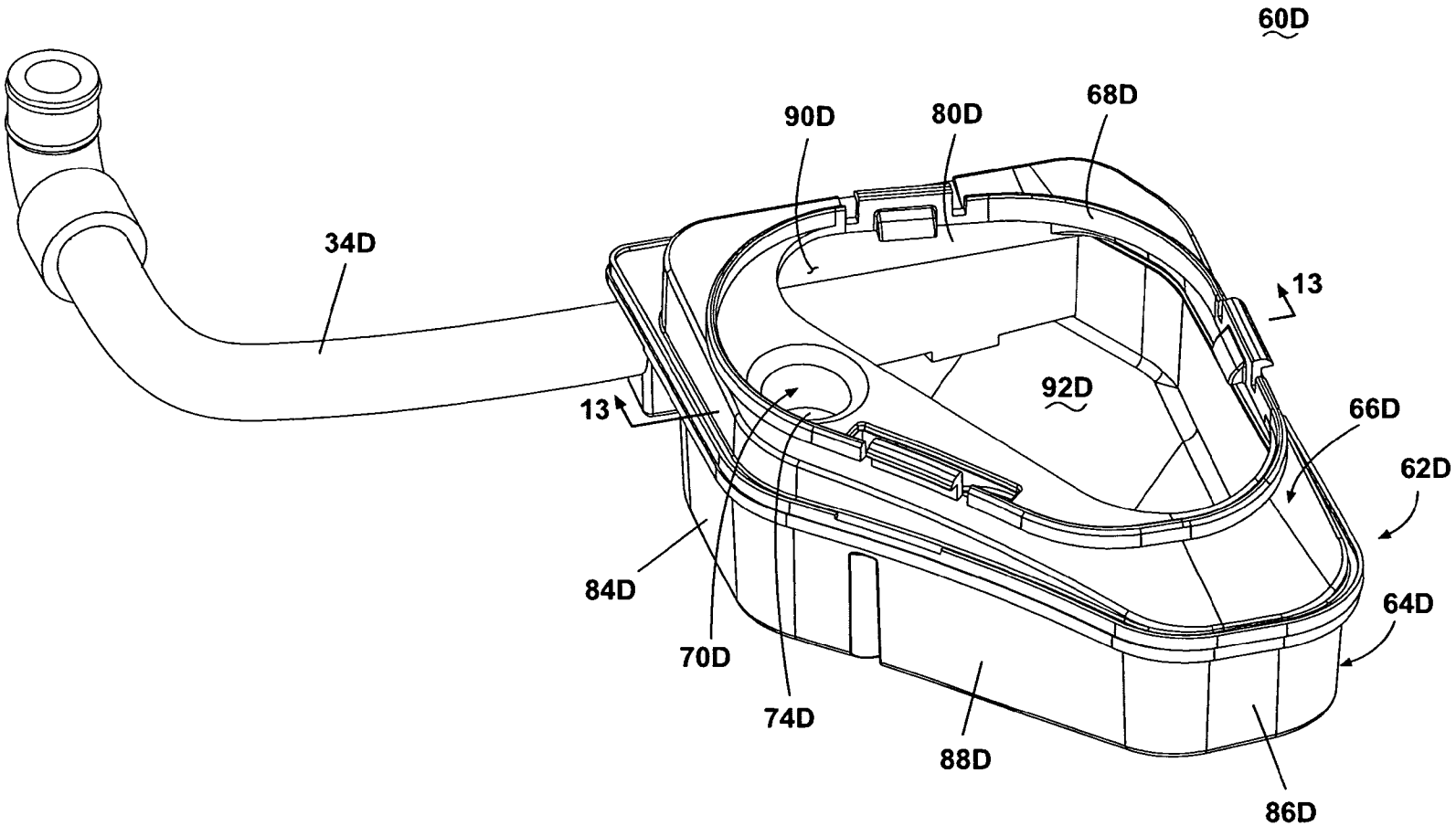
FIG. 11 is a perspective view of an alternative embodiment of the agent dispenser according to one embodiment of the invention.
Figure 12:
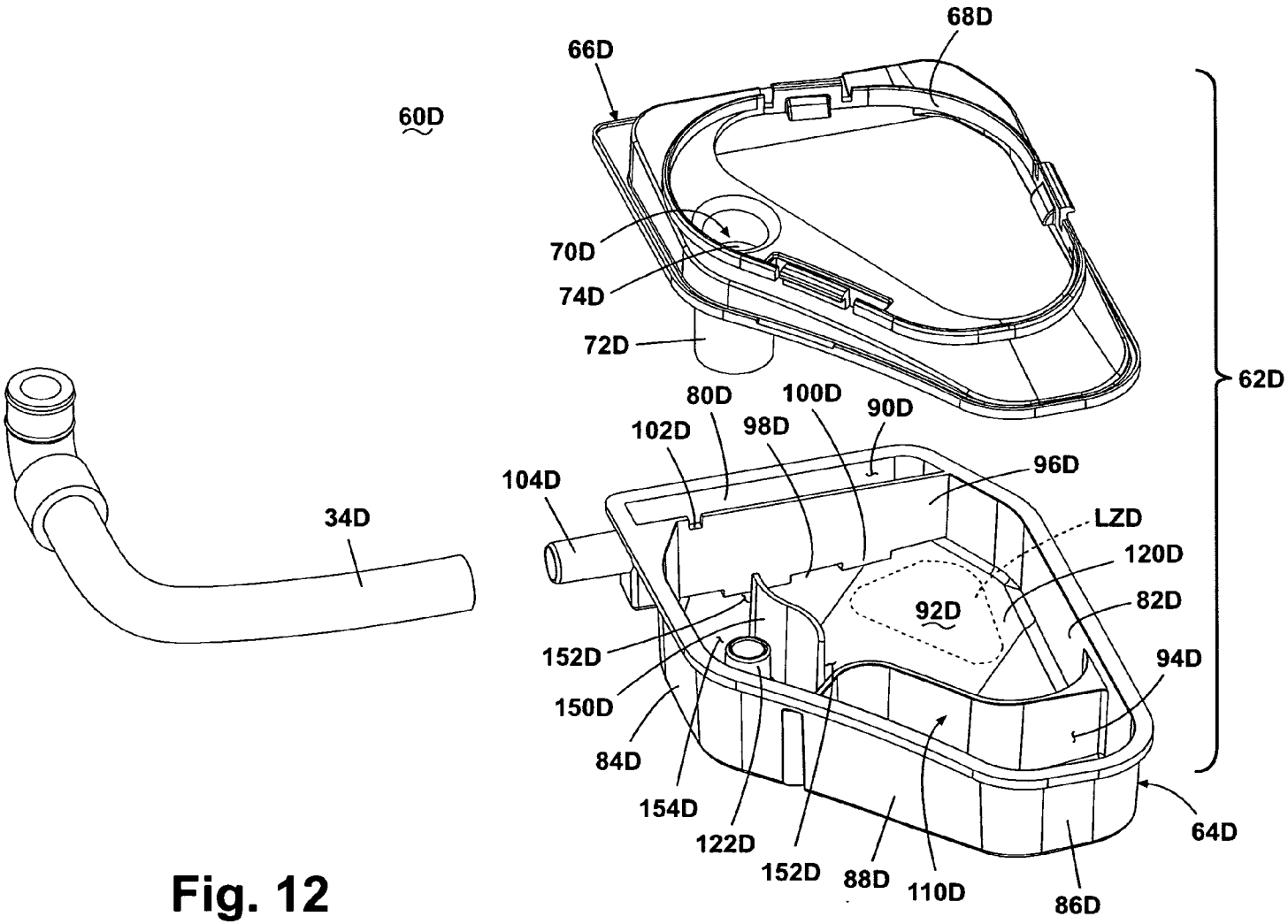
FIG. 12 is an exploded view of the agent dispenser of FIG. 11.
Figure 13:
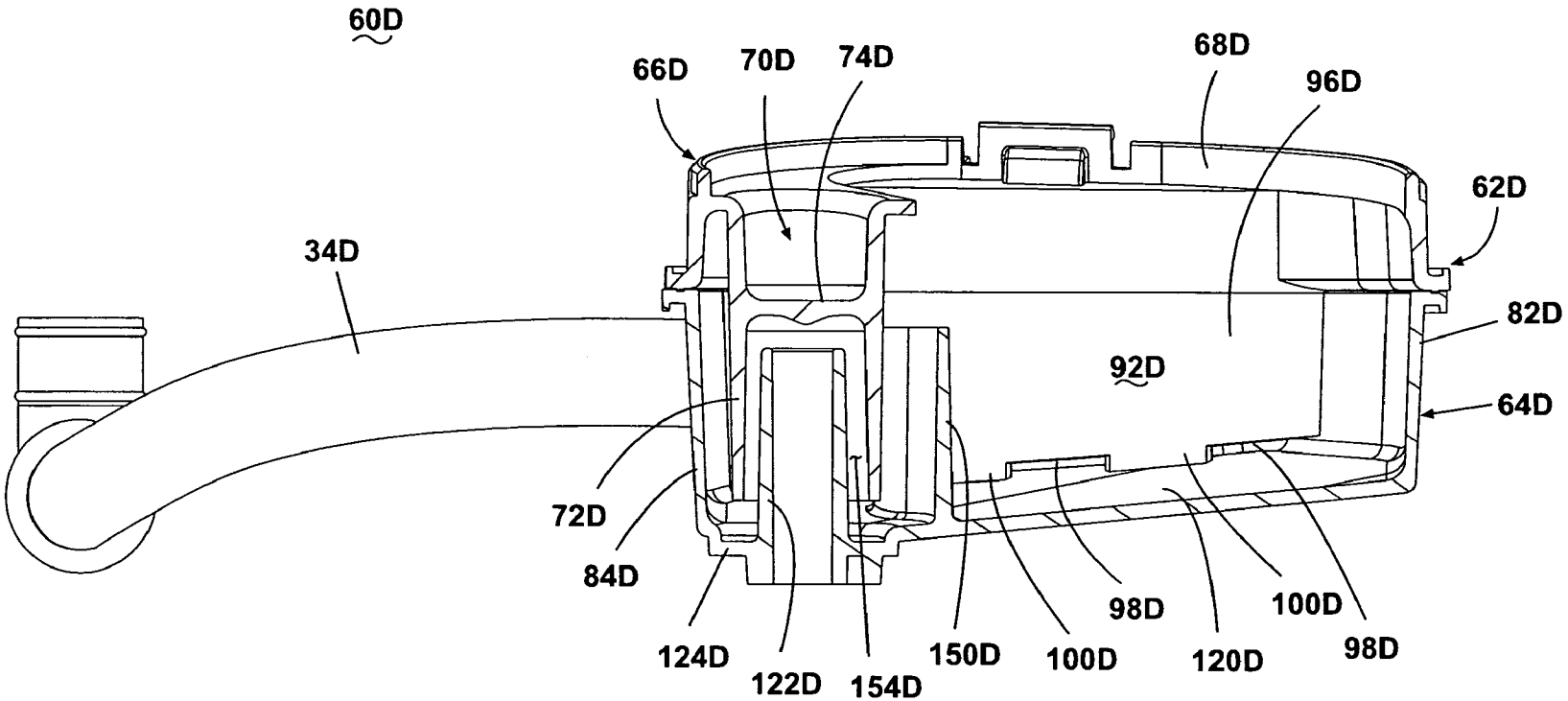
FIG. 13 is a sectional view taken along line 13-13 of FIG. 11.

Another embodiment of the agent dispenser 60D is illustrated in FIGS. 11-13, where elements similar to those of the agent dispenser 60 in the embodiment of FIGS. 3-6 are identified with the same reference numeral bearing the letter "D." As seen in FIG. 11, the agent dispenser 60C is similar to the agent dispenser of FIGS. 3-6, except for some cosmetic differences and the presence of a siphon wall 150D, which can be seen in the exploded view of FIG. 12, extending upwardly from the bottom 120D. The siphon wall 150D may be located in the agent compartment 92D between the loading zone LZD and the siphon tube 122D to form a siphon compartment 154D around the siphon tube 122D, which, in the illustrated embodiment, is located near the third side wall 84D between the wall 96 and the overflow wall 110. The siphon compartment 154D may fluidly communicate with the agent compartment 92D through gaps 152D formed between the siphon wall 150D and the wall 96D and the overflow wall 110D. Further, as seen in FIG. 13, which is a sectional view of the agent dispenser 60D taken along a line through the siphon tube 122D, the siphon wall 150D may have a height less than the distance between the bottom 120D and the cover 66D. The siphon wall 150D may provide a barrier between the loading zone LZD and the siphon compartment 154D to avoid or reduce the mixing of the agent in the agent compartment 92D with residual water that may remain in the siphon compartment 154D from the previous operation cycle. The operation of the agent dispenser 60D is substantially similar to that of the agent dispenser 60 described above, except that the agent, water, and agent solution in the agent compartment 92D must flow around the siphon wall 150D through the gaps 152D to reach the siphon tube 122D. Further, the alternatives for the receptacle 64 described above may also be incorporated into the receptacle 64D or other embodiments of the receptacle 64.

The embodiments of the agent dispenser described above are configured for manual introduction of the agent through the opening in the cover; however, it is within the scope of the invention for the agent dispenser to incorporate other configurations for loading the agent. For example, the agent dispenser may be configured for automatic loading of the agent, for example, through a drawer-type sliding mechanism or a pivoting-type door mechanism, or other configurations known to those skilled in the art.

The embodiments of the agent dispenser described above are configured with a single agent compartment to hold one agent at a time; however, it is within the scope of the invention for the agent dispenser to be configured to hold more than one agent, such as by incorporating more than one agent compartment, with one or more of the agent compartments fluidly communicating with the inlet compartment in the manners described above such that the water enters the agent compartment at the bottom of the agent compartment. Further, the agent dispenser may include a separate inlet compartment and/or separate outlet compartment for each of the agent compartments in the agent dispenser.

While the invention has been specifically described in connection with certain specific embodiments thereof, it is to be understood that this is by way of illustration and not of limitation, and the scope of the appended claims should be construed as broadly as the prior art will permit.

What is claimed is:

1. An agent dispenser for a fabric treatment apparatus, the agent dispenser comprising:

a housing;

a manifold having at least one inlet port and at least one outlet port, which is in fluid communication with the inlet port;

an agent compartment located in the housing and having a bottom in fluid communication with the at least one outlet port; and a siphon tube in fluid communication with the agent compartment to siphon agent and water from the agent compartment;

wherein the at least one outlet port is located in the manifold immediately adjacent to the bottom of the agent compartment such that water flowing through the at least one outlet port into the bottom of the agent compartment generates a turbulent flow of water that lifts, suspends, and jostles the agent in the agent compartment to mix with the agent in the agent compartment substantially from the bottom up and fill up the agent compartment until the water and agent mixture is siphoned by the siphon tube.

2. The agent dispenser according to claim 1 wherein the manifold comprises an inlet compartment in the housing.

3. The agent dispenser according to claim 2, further comprising a wall separating the inlet compartment from the agent compartment, wherein the at least one outlet port is an opening in the wall to fluidly communicate the inlet compartment with the agent compartment.

4. The agent compartment according to claim 3 wherein the at least one opening is located substantially at a bottom of the wall and extends substantially the length of the wall.

5. The agent dispenser according to claim 3 wherein the at least one opening is sized to establish a flow of water from the inlet compartment into the agent compartment across the bottom of the agent compartment.

6. The agent dispenser according to claim 3 wherein the inlet compartment is adjacent to the agent compartment.

7. The agent dispenser according to claim 3 wherein the wall extends about one-quarter to three-quarters around the perimeter of the agent compartment.

8. The agent dispenser according to claim 1 further comprising an overflow compartment in the housing to accommodate overflow from the agent compartment.

9. The agent dispenser according to claim 8 wherein the overflow compartment is adjacent to the agent compartment.

10. The agent dispenser according to claim 8, further comprising a wall separating the overflow compartment and the agent compartment.

11. The agent dispenser according to claim 1, further comprising a well in the agent compartment, wherein the siphon tube is located within the well.

12. The agent dispenser according to claim 1 wherein the agent compartment comprises a loading zone configured to receive the agent, and a wall between the loading zone and the siphon tube.

13. The agent dispenser according to claim 1, further comprising an air vent between the manifold and the agent compartment.

14. The agent dispenser according to claim 1 wherein the agent compartment comprises a loading zone configured to hold the agent and an opening in registry with the loading zone to receive the agent.

15. The agent dispenser according to claim 1 wherein the agent comprises at least one of a detergent, a bleach, and a fabric softener.

16. The agent dispenser according to claim 1 wherein the manifold has more than one outlet port.

17. The agent dispenser according to claim 1 wherein the at least one outlet port is configured to cause a flow of water from the manifold into the agent compartment substantially across the bottom of the agent compartment.

18. A fabric treatment apparatus comprising:

a receptacle defining a fabric treatment chamber; and an agent dispenser fluidly coupled to the receptacle to supply an agent to the fabric treatment chamber, the agent dispenser comprising:

a housing;

a manifold having at least one inlet port and at least one outlet port, which is in fluid communication with the at least one outlet port;

an agent compartment in the housing configured to receive an agent in liquid or powder form, and having a bottom wall; and a siphon tube in fluid communication with the agent compartment to siphon agent and water from the agent compartment;

wherein the at least one outlet port is located in the manifold immediately adjacent the bottom of the agent compartment such that water is supplied from the at least one outlet port to the bottom of the agent compartment and turbulently lifts, suspends, jostles, and substantially mixes with the agent in the agent compartment from the bottom up and fill up the agent compartment until the water and agent mixture is siphoned by the siphon tube.

19. The fabric treatment apparatus according to claim 18 wherein the manifold comprises an inlet compartment in the housing.

20. The fabric treatment apparatus according to claim 19 wherein the agent dispenser further comprises a wall separating the inlet compartment from the agent compartment, wherein the at least one outlet port is an opening in the wall to fluidly communicate the inlet compartment with the agent compartment.

21. The fabric treatment apparatus according to claim 20 wherein the at least one opening is located substantially at a bottom of the wall.

22. The fabric treatment apparatus according to claim 20 wherein the at least one opening is sized to establish a flow of water from the inlet compartment into the agent compartment across the bottom of the agent compartment.

23. The fabric treatment apparatus according to claim 20 wherein the inlet compartment is adjacent to the agent compartment.

24. The fabric treatment apparatus according to claim 23 wherein the wall extends about one-quarter to three-quarters around the perimeter of the agent compartment.

25. The fabric treatment apparatus according to claim 18 wherein the agent dispenser further comprises an overflow compartment in the housing to accommodate overflow from the agent compartment.

26. The fabric treatment appliance according to claim 25 wherein the overflow compartment is adjacent to the agent compartment.

27. The fabric treatment apparatus according to claim 25 wherein the agent dispenser further comprises a wall separating the overflow compartment and the agent compartment.

28. The fabric treatment apparatus according to claim 18 wherein the agent dispenser further comprises a siphon tube in fluid communication with the agent compartment to siphon the agent and the water from the agent compartment.

29. The fabric treatment apparatus according to claim 28 wherein the agent dispenser further comprises a well in the agent compartment, and the siphon tube is located within the well.

30. The fabric treatment apparatus according to claim 28 wherein the agent compartment comprises a loading zone configured to receive the agent, and a wall between the loading zone and the siphon tube.

31. The fabric treatment apparatus according to claim 28 wherein the agent dispenser further comprises an air vent between the manifold and the agent compartment.

32. The fabric treatment apparatus according to claim 18 wherein the agent compartment comprises a loading zone configured to hold the agent and an opening in registry with the loading zone to receive the agent.

33. The fabric treatment apparatus according to claim 18 wherein the agent comprises at least one of a detergent, a bleach, and a fabric softener.

34. The fabric treatment apparatus according to claim 18 wherein the manifold has more than one outlet port.

35. The fabric treatment apparatus according to claim 1 wherein the manifold has more than one inlet port.

36. The fabric treatment apparatus according to claim 18 further comprising a drum located in the receptacle and configured to receive laundry for treatment in the fabric treatment chamber.

* * * * *

UNITED STATES PATENT AND TRADEMARK OFFICE

CERTIFICATE OF CORRECTION

PATENT NO. : 7,900,486 B2
APPLICATION NO. : 11/841216
DATED : March 8, 2011
INVENTOR(S) : Lonnie Joe Richman et al.

It is certified that error appears in the above-identified patent and that said Letters Patent is hereby corrected as shown below:

Col. 13, lines 11-13, Claim 26: "The fabric treatment appliance according to claim 25 wherein the overflow compartment is adjacent to the agent compartment." - should be Claim 26: -- The fabric treatment apparatus according to claim 25 wherein the overflow compartment is adjacent to the agent compartment. --

Col. 14, lines 17-18, Claim 35: "The fabric treatment apparatus according to claim 1 wherein the manifold has more than one inlet port." - should be Claim 35: -- The fabric treatment apparatus according to claim 18 wherein the manifold has more than one inlet port. --

Signed and Sealed this
Fourteenth Day of February, 2012

David J. Kappos

David J. Kappos
*Director of the United States Patent and Trademark Office*